United States Patent [19]

Seki

[11] Patent Number: 4,609,113

[45] Date of Patent: Sep. 2, 1986

[54] CUP PERMITTING EASY DRINKING-UP

[76] Inventor: Norio Seki, 82-1 Kakida, Shimizu-cho, Suntou-gun, Shizuoka-ken, Japan

[21] Appl. No.: 657,335

[22] Filed: Oct. 3, 1984

[30] Foreign Application Priority Data

May 8, 1984 [JP] Japan ..... 59-90202

[51] Int. Cl.[4] ..... B65D 23/00

[52] U.S. Cl. ..... 215/1 R; 215/1 C; 150/55; 229/1.5 B

[58] Field of Search ..... 215/1 R, 1 C; 229/1.5 B; 150/55; 206/217, 218; 220/1 R, 72

[56] References Cited

U.S. PATENT DOCUMENTS

| | | | |
|---|---|---|---|
| 2,905,350 | 9/1959 | Edwards | 215/1 C |
| 3,083,877 | 4/1963 | Gash | 215/1 C |
| 3,201,111 | 8/1965 | Afton | 215/1 C |
| 3,434,589 | 3/1969 | Valtri et al. | 150/55 |
| 3,939,887 | 2/1976 | Scarnato | 150/55 |
| 3,939,888 | 2/1976 | Scarnato | 150/55 |
| 4,324,340 | 4/1982 | Belokin, Jr. | 215/1 C |

FOREIGN PATENT DOCUMENTS

| | | | |
|---|---|---|---|
| 1408869 | 6/1965 | France | 215/1 C |

*Primary Examiner*—William Price
*Assistant Examiner*—David T. Fidei
*Attorney, Agent, or Firm*—Poms, Smith, Lande & Rose

[57] ABSTRACT

Disclosed herein is a cup permitting easy drinking-up of its liquid content. The cylindrical side wall of the cup is composed of a thin-walled material having suitable degrees of flexibility and elasticity, and a number of bellows-like corrugations are provided in the cylindrical side wall in such a way that the corrugations extend substantially in parallel with the bottom wall of the cup. The corrugations are allowed to undergo collapse when the upper edge of the cup is brought into contact with the nose ridge of a user. Thus, the user can drink up the liquid content of the cup to the last drop without need for turning his face upward.

4 Claims, 9 Drawing Figures

CUP PERMITTING EASY DRINKING-UP

BACKGROUND OF THE INVENTION (1) Field of the Invention

This invention relates to a cup permitting easy drinking-up of its liquid content without need for turning user's face upward.

(2) Description of the Prior Art

In order to drink up a drink, beverage or the like from a conventional cup, mug, tumbler or the like (hereinafter generally called "cup" for the sake of brevity), it is necessary to hold up the bottom of the cup, from which the user has been drinking the drink, beverage or the like while maintaining the cup in a forward- and downward-directed position, so that the rear side of the cup, in other words, the side closer to the face of the user is turned counterclockwise beyond the horizontal level into a forward- and upward-directed position.

When the bottom of the cup is raised while keeping the user's mouth in contact with a rear portion of the upper edge of the cup, a front portion of the upper edge is eventually brought into contact with the nose ridge of the user.

It is thus necessary to bend his neck rearward and to turn his face upward if the user wants to hold up the bottom of the cup beyond a certain limitation. This is however difficult and often painful for those handicapped in the movement of their necks due to whiplash injuries or the like, those having problems in their spines, bedridden patients, etc.

After brushing teeth with a tooth brush, the mouth is washed with water from a cup. Here again, he is necessary to turn his face upward and to raise the bottom of the cup so that an adequate amount of water is caused to flow into his mouth. This is really cumbersome.

Furthermore, it is in some instances not nice-looking or attractive especially for a lady to bend her head significantly rearward and to drink up a drink, beverage or the like. Such a drinking manner may be impolite depending on what kind of people are sitting around.

SUMMARY OF THE INVENTION

With the foregoing in view, it would be very convenient and polite if there would be a cup permitting the complete drinking-up of its content while still holding his face somewhat downward without need for turning his face upward.

The present invention has been completed from such a viewpoint as mentioned above.

In one aspect of this invention, there is thus provided a cup permitting easy drinking-up of its liquid content, wherein the cylindrical side wall of the cup is composed of a thin-walled material having suitable degrees of flexibility and elasticity, and a number of bellows-like corrugations are provided in the cylindrical side wall in such a way that the corrugations extend substantially in parallel with the bottom wall of the cup.

By the term "substantially in parallel with the bottom wall of the cup" as used herein, it is meant that the corrugations extend in such directions that they are allowed to undergo collapse when brought into contact with the nose ridge of a user to drink up the liquid content of the cup.

Owing to the provision of the bellows-like corrugations coupled with the flexible and elastic nature of the cylindrical side wall, it is readily possible to drink up a drink, beverage or the like from the cup without need for turning his face upward, in other words, while holding his face upright.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENTS

(First Embodiment)

Figure 1:
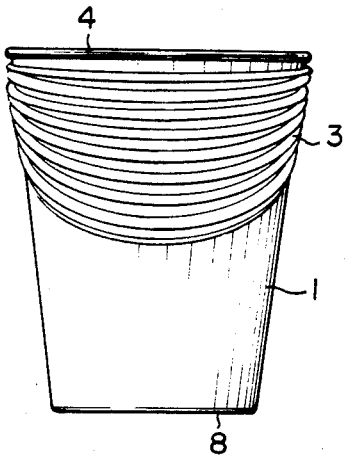
FIG. 1 is a front elevation of a cup according to the first embodiment of this invention.
Figure 2:
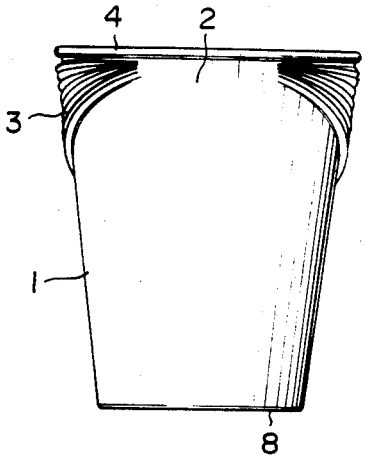
FIG. 2 is a rear elevation of the cup of FIG. 1.
Figure 3:
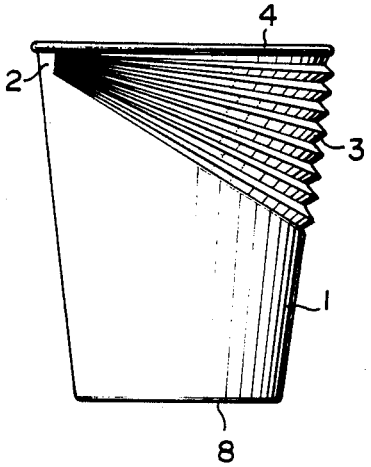
FIG. 3 is a lefthand side elevation of the cup of FIG. 1.

FIG. 1 to FIG. 3 illustrate the first embodiment of this invention.

The illustrated cup is composed of a material having suitable degrees of flexibility and elasticity, such as thin paper or plastic sheet. A smooth surface 2 is left with a certain appropriate width on a rear portion of an upper part of a cylindrical side wall 1, which rear portion is adapted to a lip-contacting portion. From both sides of the smooth surface 2 to a front portion of the cylindrical side wall 1, a number of bellows-like corrugations 3 are provided in such a way that the corrugations 3 extend in forward- and somewhat downward-directions.

Upon placing a drink in the cup and drinking the content of the cup by holding the mouth in contact with a rear portion of the upper edge 4, namely, in contact with the upper edge 4 at a portion located in adjacent to the smooth surface 2, it is required to raise the rear side of the cylindrical side wall 1 of the cup into a forwardly-extending position as the remaining portion of the drink becomes smaller.

Figure 4:
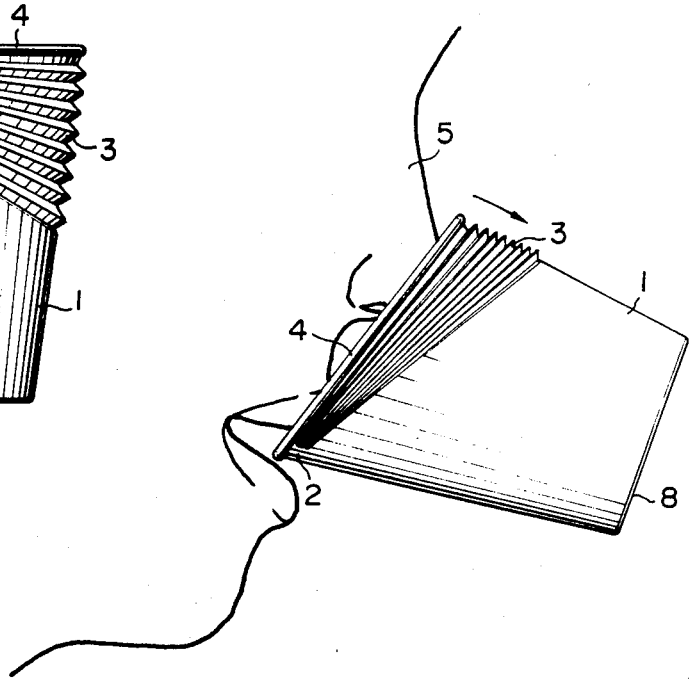
FIG. 4 is a side view of the cup of FIG. 1 in use.

When the rear side of the cylindrical side wall 1 has been raised into a forwardly-extending position beyond a certain level, a front portion of the upper edge 4 is brought into light contact with the nose ridge 5 of the user as illustrated in FIG. 4. Then, the upper part of the front side of the cylindrical side wall 1 is allowed to undergo progressive collapse owing to the provision of the corrugations 3.

Accordingly, the user can drink up the content of the cup to the last drop without turning his face upward at all or to any substantial extent.

Since the upper part of the rear side of the cylindrical side wall 1 is formed into the smooth surface 2, no drink is allowed to remain there when drinking the drink from the cup. When the front portion of the upper edge 4 of the cylindrical side wall 1 has been brought into contact with the nose ridge 5, the smooth surface 2 serves as if it is the fulcrum of the counterclockwise movement of the cup, whereby facilitating the collapse of the corrugations 3. In a modified embodiment, the corrugations 3 may be formed in parallel to one another on the front side of the cup.

(Second Embodiment)

Figure 5:
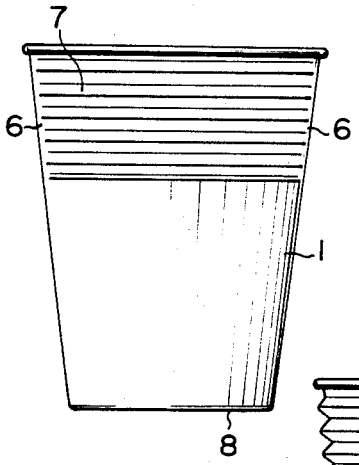
FIG. 5 is a front elevation of a cup according to the second embodiment of this invention.
Figure 6:
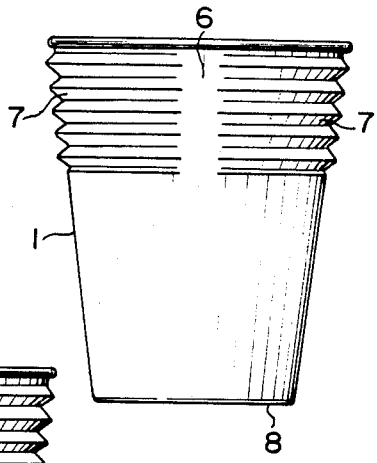
FIG. 6 is a side view of the cup of FIG. 5.

In the second embodiment of this invention depicted in FIG. 5 and FIG. 6, smooth surfaces 6,6 of a small width are left on both side surfaces of the upper half part of a cylindrical side wall 1 which is made of a material similar to that employed in the first embodiment. Between the left and right smooth surfaces 6,6, a number of bellows-like corrugations 7 are provided in such a way that the corrugations 7 extend substantially in parallel with the bottom wall of the cup.

Figure 7:
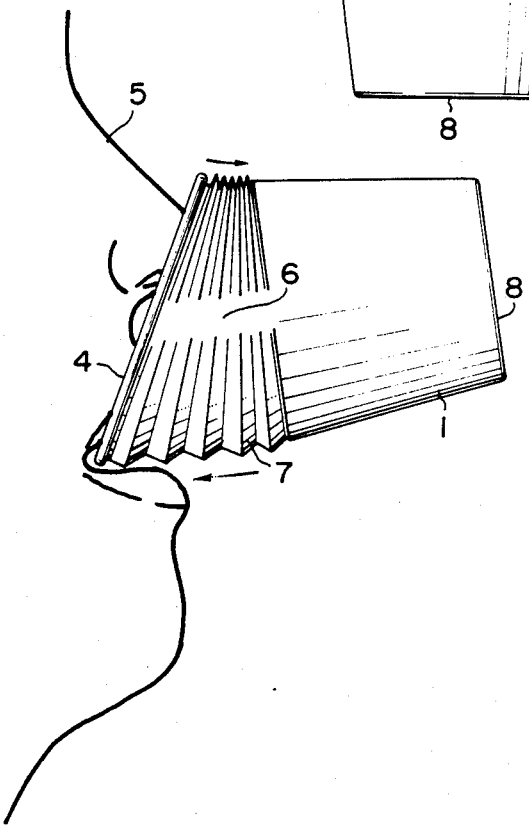
FIG. 7 is a side view of the cup of FIG. 6 in use.
Figure 9:
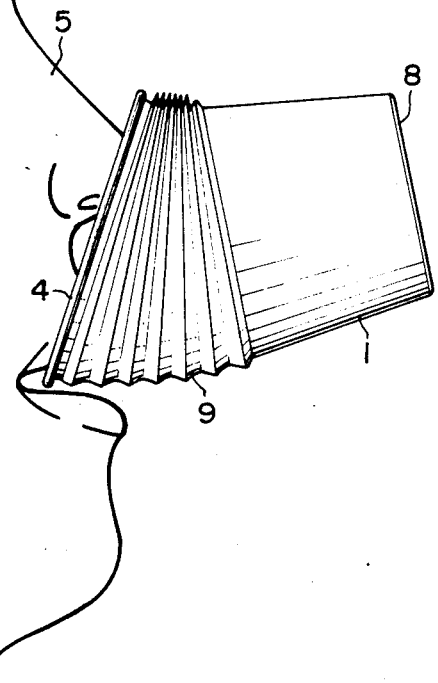
FIG. 9 is a side view of the cup of FIG. 8 in use.

When the bottom wall 8 of the cup is raised upon drinking the content of the cup, the upper edge 4 is brought into contact with the nose ridge 5. Then, as depicted in FIG. 7, the upper corrugations 7 located above the smooth surfaces 6,6 are collapsed while the lower corrugations 7 located below the smooth surfaces 6,6 are expanded, with the smooth surfaces 6,6 serving as a fulcrum. While still holding the cup in a forward- and downward-directed position, the user is thus allowed to drink up easily the content of the cup without need for turning his face upward.

(Third Embodiment)

Figure 8:
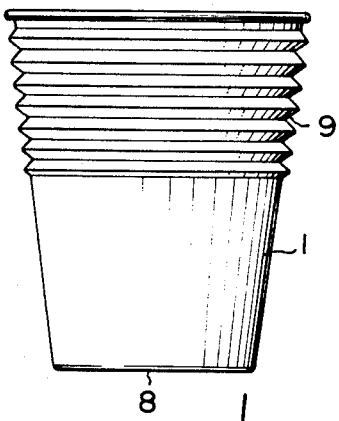
FIG. 8 is a front elevation of a cup according to the third embodiment of this invention, which also serves as a rear or side elevation.

The present embodiment may also be practiced as shown in FIG. 8, namely, by providing a number of bellows-like corrugations 9, which are parallel to one another, in at least the upper half part of a cylindrical side wall 1 made of a material similar to that employed in the preceding examples in such a way that the corrugations 9 extend substantially in parallel with the bottom wall 8 of the cup.

When the bottom wall 8 of the cup is raised upon drinking its content, the upper edge 4 is brought into contact with the nose ridge 5. Then, the corrugations 9 are collapsed and expanded respectively at the upper and lower sides of the cylindrical side wall 4, thereby facilitating the drinking-up of the content of the cup while maintaining his face in the upright position.

By the way, the corrugations 9 may be provided in the entire part of the cylindrical side wall 1. However, their provision only on the upper half part of the cylindrical side wall 1 is more convenient because the smooth lower half part of the cylindrical side wall 1 facilitates the holding of the cup.

Having now fully described the invention, it will be apparent to one of ordinary skill in the art that many changes and modifications can be made thereto without departing from the spirit or scope of the invention as set forth herein.

I claim:

1. In a cup adapted for use by an individual in drinking liquids therefrom, wherein said cup includes a bottom wall and a cylindrical side wall extending upward from said cup bottom, said side wall terminating in an upper annular edge, wherein a portion of said upper annular edge is contacted with the individual's lips for drinking, and wherein the cup is tilted during drinking so that the portion of said annular edge opposite said lip-contact portion contacts the individual's face to thereby permit the individual from drinking the entire contents of the cup without tilting his head backwards, wherein the improvement comprises:

means for selectively collapsing the cylindrical side wall of said cup so that the portion of said side wall located under the face-contact portion of said annular edge collapses when said face-contact portion contacts the individual's face, but where the portion of the side wall under said lip-contact portion remains rigid to thereby allow the individual to drink the entire contents of the cup without having to tilt their head backwards; wherein said means for selectively collapsing the cylindrical side wall includes collapsible bellows-like corrugations in said cylindrical side wall portion located parallel to and under the face-contact portion of the annular edge, said bellows-like corrugations extending partially around said cylindrical side wall and having an area located under the lip-contact portion of said annular edge free of said means to thereby prevent the portion of said side wall located under said lip-contact portion from collapsing.

2. An improved cup according to claim 1 wherein said bellows-like corrugations are located only in the upper portion of said side wall adjacent to said upper edge.

3. An improved cup according to claim 1 wherein said bellows-like corrugations include a plurality of parallel ridges and valleys, said ridges being laterally spaced from each other, wherein said ridges and valleys extend around said cylindrical side wall under the face-contact portion of the upper edge and terminate at first and second locations located on opposite sides of the portion of the side wall located under the lip-contact portion of the upper edge and wherein the lateral space between said ridges increases as the ridges extend around said side wall from said first and second locations.

4. A cup as claimed in claim 1, wherein the bellows-like corrugations are provided only in the upper half part of the cylindrical side wall.

* * * * *